US010450513B2

(12) United States Patent
Ho et al.

(10) Patent No.: US 10,450,513 B2
(45) Date of Patent: Oct. 22, 2019

(54) HIGH VISCOSITY BASE STOCK COMPOSITIONS

(71) Applicant: ExxonMobil Research and Engineering Company, Annandale, NJ (US)

(72) Inventors: Suzzy C. H. Ho, Princeton, NJ (US); Charles L. Baker, Jr., Thornton, PA (US); Shuji Luo, Basking Ridge, NJ (US); Halou Oumar-Mahamat, Belle Mead, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/376,200

(22) Filed: Apr. 5, 2019

(65) Prior Publication Data

US 2019/0233737 A1 Aug. 1, 2019

Related U.S. Application Data

(62) Division of application No. 15/332,352, filed on Oct. 24, 2016, now Pat. No. 10,301,550.
(Continued)

(51) Int. Cl.
*C10G 7/00* (2006.01)
*C10G 69/12* (2006.01)
(Continued)

(52) U.S. Cl.
CPC ..... *C10G 7/00* (2013.01); *C10G 50/02* (2013.01); *C10G 67/02* (2013.01); *C10G 69/02* (2013.01);
(Continued)

(58) Field of Classification Search
CPC ..... C10G 7/00; C10G 69/12; C10G 50/02; C10G 67/02; C10G 69/02; C10M 101/02;
(Continued)

(56) References Cited

U.S. PATENT DOCUMENTS 4,913,794 A 4/1990 Le et al.
4,931,197 A 6/1990 Beck et al.
(Continued)

FOREIGN PATENT DOCUMENTS

DE 2361653 A1 6/1974
EP 0620264 A2 10/1994
(Continued)

OTHER PUBLICATIONS

International Search Report and Written Opinion PCT/US2016/058422 dated Feb. 2, 2017.
(Continued)

*Primary Examiner* — Pamela H Weiss
(74) *Attorney, Agent, or Firm* — Robert A. Migliorini; Scott F. Yarnell

(57) ABSTRACT

Methods are provided for producing Group II base stocks having high viscosity and also having one or more properties indicative of a high quality base stock. The resulting Group II base stocks can have a viscosity at 100° C. and/or a viscosity at 40° C. that is greater than the corresponding viscosity for a conventional Group II base stock. Additionally, the resulting Group II base stocks can have one or more properties that are indicative of a high quality base stock.

4 Claims, 12 Drawing Sheets

Related U.S. Application Data

(60) Provisional application No. 62/254,756, filed on Nov. 13, 2015.

(51) Int. Cl.

| | |
|---|---|
| ***C10G 67/02*** | (2006.01) |
| ***C10M 101/02*** | (2006.01) |
| ***C10G 69/02*** | (2006.01) |
| ***C10M 171/02*** | (2006.01) |
| ***C10G 50/02*** | (2006.01) |
| ***C10M 109/02*** | (2006.01) |

(52) U.S. Cl.
CPC ..... *C10G 69/12* (2013.01); *C10M 101/02* (2013.01); *C10M 109/02* (2013.01); *C10M 171/02* (2013.01); *C10M 2203/1025* (2013.01); *C10M 2205/0285* (2013.01); *C10N 2220/021* (2013.01); *C10N 2220/022* (2013.01); *C10N 2230/02* (2013.01); *C10N 2230/10* (2013.01); *C10N 2240/04* (2013.01); *C10N 2260/02* (2013.01); *C10N 2270/00* (2013.01)

(58) Field of Classification Search
CPC ..... C10M 171/02; C10M 109/02; C10M 2205/0285; C10M 2203/1025; C10N 2220/022; C10N 2230/10; C10N 2260/02; C10N 2230/02; C10N 2240/04; C10N 2220/021; C10N 2270/00
See application file for complete search history.

(56) References Cited

U.S. PATENT DOCUMENTS

| | | | | |
|---|---|---|---|---|
| 4,990,713 | A | 2/1991 | Le et al. | |
| 5,132,478 | A | 7/1992 | Ho et al. | |
| 5,271,825 | A | 12/1993 | Bortz et al. | |
| 5,306,416 | A | 4/1994 | Le et al. | |
| 6,660,894 | B1 | 12/2003 | Wu et al. | |
| 7,537,685 | B2 | 5/2009 | Chen et al. | |
| 7,989,670 | B2 * | 8/2011 | Wu | C08F 10/00 585/250 |
| 8,227,392 | B2 * | 7/2012 | Wu | C08F 10/08 508/591 |
| 8,513,478 | B2 * | 8/2013 | Wu | C08F 10/00 585/523 |
| 10,294,438 | B2 * | 5/2019 | Ho | C10G 7/00 |
| 10,301,550 | B2 * | 5/2019 | Ho | C10G 7/00 |
| 10,301,557 | B2 * | 5/2019 | Ho | C10G 57/00 |
| 2002/0117424 | A1 | 8/2002 | Drake et al. | |
| 2007/0284284 | A1 | 12/2007 | Zones et al. | |
| 2010/0036038 | A1 | 2/2010 | Rodgers et al. | |
| 2010/0323937 | A1 * | 12/2010 | Wu | C08F 10/08 508/591 |
| 2013/0217606 | A1 | 8/2013 | Wang et al. | |
| 2013/0317265 | A1 | 11/2013 | Small et al. | |
| 2014/0213834 | A1 | 7/2014 | Patil et al. | |
| 2014/0378720 | A1 | 12/2014 | Wu et al. | |

FOREIGN PATENT DOCUMENTS

| | | |
|---|---|---|
| GB | 1454498 A | 11/1976 |
| WO | 9858972 A1 | 12/1998 |

OTHER PUBLICATIONS

International Search Report and Written Opinion PCT/US2016/058424 dated Feb. 2, 2017.
International Search Report and Written Opinion PCT/US2016/058430 dated Feb. 2, 2017.

* cited by examiner

| Description | | EHC 110 Group II Heavy Neutral | CORE 2500 Group I Bright Stock | Ex. 1 | Ex. 2 | Ex. 3 | Ex. 4 | Ex. 5 | Ex. 6 |
|---|---|---|---|---|---|---|---|---|---|
| Derived from | | NA | NA | EHC 20 | EHC 20 | EHC 20 | EHC 45 | EHC 20 | F-T liquid |
| Amount of Peroxide Added/Add Time | | NA | NA | 10%/2 hrs | 30%/2 hrs | 30%/4 hrs | 30%/4 hrs | 100%/4 hrs | 30%/2 hrs |
| Hydrofinished | | NA | NA | No | Yes | Yes | Yes | No | No |
| Viscosity @ 100°C, cSt | Kinematic Viscosity | 10.4 | 31.6 | 20.2 | 20.5 | 28.6 | 43.4 | 65.3 | 27.8 |
| Viscosity @ 40°C, cSt | Kinematic Viscosity | 89.8 | 476 | 227 | 206 | 360 | 639 | 1205 | 316.6 |
| Viscosity Index | | 97 | 97 | 103 | 116 | 109 | 113 | 112 | 118 |
| Density@15.6°C, g/cc | | 0.8766 | 0.9019 | 0.8625 | 0.8577 | 0.8630 | 0.8788 | 0.8750 | 0.8515 |
| Sulfur, % | ASTM D2622-1 | 0.0011% | 1.15% | ND | <0.0005% | <0.0005% | 0.0006% | ND | ND |
| Aniline Point, °C | ASTM D611 | 119.4 | 120.0 | 133.8 | 140.8 | 143.4 | 144.1 | 150.2 | 146.4 |
| Aniline Point Index | Actual /Expected | 0.995 | NA | 1.05 | 1.11 | 1.10 | 1.06 | 1.07 | 1.12 |
| Glass Transition Temperature Tg, °C | Differential Scanning Calorimetry (DSC) | ND | -58.8 | ND | -78.34 | -70.54 | -67.99 | ND | -73.6 |
| Crystallization Temperature Tc, °C | DSC | ND | -6.25 | ND | <-60°C | <-60°C | -33.23 | ND | None Detected |
| Quantitative Carbon-13 NMR | | | | | | | | | |
| % Epsilon Carbon | @ 29 - 31 ppm | 22.7% | 27.3% | 22.6% | 21.1% | 21.4% | 23.3% | 21.6% | 20.4% |
| % Aromatic Carbon | @ 117 – 150 ppm | 0.4% | 5.1% | ND | 0.0% | 0.0% | 0.9% | ND | 0.0% |

FIG. 9

HIGH VISCOSITY BASE STOCK COMPOSITIONS

CROSS-REFERENCE TO RELATED APPLICATIONS

This application is a divisional application filed under 37 C.F.R. 1.53(b) of parent U.S. patent application Ser. No. 15/332,352 filed on Oct. 24, 2016, the entirety of which is hereby incorporated herein by reference, and claims priority to U.S. Provisional Application Ser. No. 62/254,756 filed Nov. 13, 2015, which is herein incorporated by reference in its entirety. This application is related to two other co-pending U.S. application Ser. Nos. 15/332,012 and 15/332,417, filed on Oct. 24, 2016. These co-pending U.S. applications are hereby incorporated by reference herein in their entirety.

FIELD

High viscosity lubricant base stock compositions, methods for making such base stock compositions, and lubricants incorporating such base stock compositions are provided.

BACKGROUND

Conventional methods for solvent processing to form base stocks can produce various types of high viscosity base stocks, such as Group II high viscosity base stocks. However, solvent processing is generally less effective at reducing the sulfur and/or nitrogen content of a feed, which can result in base stocks with detrimental amounts of heteroatom content. Hydrotreating and/or hydrocracking processes can be used prior to and/or after solvent processing for heteroatom removal, but such hydroprocessing can significantly reduce the viscosity of the resulting hydrotreated base stock.

More generally, high viscosity base stock capacity has declined as refiners have transitioned from solvent processing for lubricant base stock production to catalytic processing. While catalytic processing is suitable for making lower viscosity base stocks, the hydrotreating and hydrocracking processes used during catalytic processing tend to limit the ability to make base stocks with viscosities greater than about 10 cSt at 100° C.

Other options for high viscosity base stocks can include specialty polymeric materials, such as the poly-alpha-olefins in ExxonMobil SpectraSyn™ base stocks. Such polymeric base stocks can have bright stock type viscosities with reduced or minimized sulfur contents. However, production of such polymeric base stocks can be costly due to a need for specialized feeds to form the desired polymer.

U.S. Pat. No. 4,931,197 describes copolymers formed from α,β-unsaturated dicarboxylic acid esters and α-olefins. The copolymers are produced by copolymerization in the presence of a peroxide catalyst at temperatures of 80° C.-210° C. The copolymers are described as suitable for use as a lubricant for the shaping treatment of thermoplastic plastics.

SUMMARY

In an aspect, a base stock composition is provided, the composition having a number average molecular weight (Mn) of 600 g/mol to 4000 g/mol, a weight average molecular weight (Mw) of 1000 g/mol to 12000 g/mol, a polydispersity (Mw/Mn) of at least 1.15, a sulfur content of 0.03 wt % or less, an aromatics content of 10 wt % or less, a kinematic viscosity at 100° C. of at least 14 cSt, a kinematic viscosity at 40° C. of at least 150 cSt, and a viscosity index of 50 to 120. Optionally, the viscosity index can be at least 80, or at least 90, or at least 100.

In another aspect, a base stock composition is provided, the composition having a number average molecular weight (Mn) of 600 g/mol to 4000 g/mol, a weight average molecular weight (Mw) of 1000 g/mol to 12000 g/mol, a polydispersity (Mw/Mn) of at least 1.15, a sulfur content of 0.03 wt % or less, an aromatics content of 10 wt % or less, a kinematic viscosity at 100° C. of at least 14 cSt, a kinematic viscosity at 40° C. of at least 150 cSt, and a saturates content of greater than 90 wt %, or greater than 95 wt %.

In still another aspect, a method of forming a base stock composition is provided, the method including introducing a feedstock having a viscosity index of 50 to 120, a kinematic viscosity at 100° C. of 12 cSt or less, a sulfur content less than 0.03 wt %, and an aromatics content less than 10 wt %, into a coupling reaction stage under effective coupling conditions to form a coupled effluent; and fractionating the coupled effluent to form at least a first product fraction having a viscosity index of 50 to 120, a polydispersity (Mw/Mn) of at least 1.15, a kinematic viscosity at 100° C. of at least 14 cSt, a kinematic viscosity at 40° C. of at least 150 cSt, and a pour point of 0° C. or less.

In yet another aspect, a method of forming a base stock composition is provided, the method including introducing a feedstock having a paraffin content of at least 90 wt %, a kinematic viscosity at 100° C. of 12 cSt or less, a sulfur content less than 0.03 wt %, and an aromatics content less than 10 wt %, into a coupling reaction stage under effective coupling conditions to form a coupled effluent; and fractionating the coupled effluent to form at least a first product fraction having a saturates content of at least 90 wt %, a polydispersity (Mw/Mn) of at least 1.15, a kinematic viscosity at 100° C. of at least 14 cSt, a kinematic viscosity at 40° C. of at least 150 cSt, and a pour point of 0° C. or less.

BRIEF DESCRIPTION OF THE DRAWINGS

FIG. 9 shows characterization data for various base stock samples.

DETAILED DESCRIPTION

Figure 1:
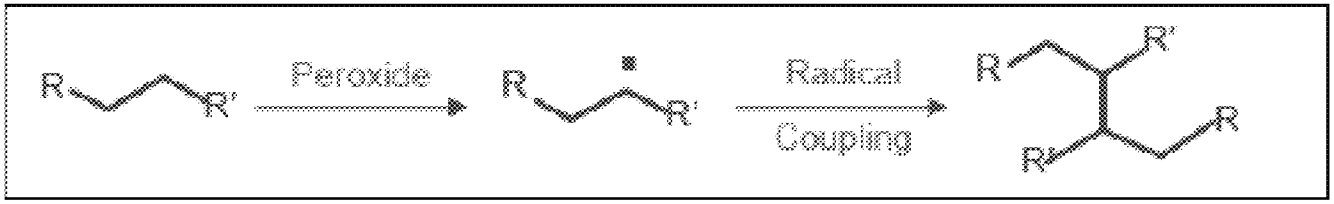
FIG. 1 schematically shows an example of a coupling reaction using a peroxide catalyst.

All numerical values within the detailed description and the claims herein are modified by "about" or "approximately" the indicated value, and take into account experimental error and variations that would be expected by a person having ordinary skill in the art.

Overview

In various aspects, methods are provided for producing Group II base stocks having high viscosity and also having one or more properties indicative of a high quality base stock. The resulting Group II base stocks can have a viscosity at 100° C. and/or a viscosity at 40° C. that is greater than the corresponding viscosity for a conventional Group II heavy neutral base stock formed by solvent processing. Additionally, the resulting Group II base stocks can have one or more of the following properties that are indicative of a high quality base stock: a sulfur content of 0.03 wt % or less; a viscosity index of at least 100; a crystallization temperature of less than −20° C.; a density of less than 0.90 g/cm3 at 15.6° C.; and/or other properties.

The high viscosity Group II base stock compositions described herein can be formed by coupling of compounds from a low viscosity conventional Group II base stock feed, or optionally another type low viscosity feed (5 cSt or less at 100° C.) having a viscosity index of at least about 50, and a suitable aromatics and sulfur content for forming a final high viscosity product (optionally after additional catalytic processing) with a sulfur content of less than 0.03 wt % and an aromatics content of less than 10 wt %. In this discussion, coupling of compounds is defined to include alkylation, oligomerization, and/or other reactions for combining and/or coupling molecules to increase molecular weight. It has been unexpectedly discovered that high molecular weight compositions having a desirable mix of properties can be formed by coupling components from a conventional base stock feed. The resulting compositions can have many of the benefits of a high molecular weight composition while also retaining many of the desirable properties of a conventional low molecular weight Group II base stock. Because the composition is formed from coupling of compounds from a lower viscosity conventional Group II base stock or another type of low viscosity feed, the initial feed can be hydroprocessed to provide a desirable sulfur, nitrogen, and/or aromatics content prior to coupling to form the high viscosity bright stock. Although such hydroprocessing will typically reduce the viscosity of a base stock, the coupling of the base stock to form higher molecular weight compounds results in a substantially increased viscosity. As a result, any viscosity loss due to hydroprocessing is reduced, minimized, and/or mitigated.

According to API's classification, Group I base stocks are defined as base stocks with less than 90 wt % saturated molecules and/or at least 0.03 wt % sulfur content. Group I base stocks also have a viscosity index (VI) of at least 80 but less than 120. Group II base stocks contain at least 90 wt % saturated molecules and less than 0.03 wt % sulfur. Group II base stocks also have a viscosity index of at least 80 but less than 120. Group III base stocks contain at least 90 wt % saturated molecules and less than 0.03 wt % sulfur, with a viscosity index of at least 120.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point or distillation point for a feed is defined as the temperature at which 5 wt % of the feed is distilled or boiled off. Similarly, a "T95" boiling point is a temperature at which 95 wt % of the feed is distilled or boiled off.

In this discussion, unless otherwise specified the lubricant product fraction of a catalytically and/or solvent processed feedstock corresponds to the fraction having an initial boiling point and/or a T5 distillation point of at least about 370° C. (700° F.). A distillate fuel product fraction, such as a diesel product fraction, corresponds to a product fraction having a boiling range from about 177° C. (350° F.) to about 370° C. (700° F.). Thus, distillate fuel product fractions have initial boiling points (or alternatively T5 boiling points) of at least about 193° C. and final boiling points (or alternatively T95 boiling points) of about 370° C. or less. A naphtha fuel product fraction corresponds to a product fraction having a boiling range from about 35° C. (95° F.) to about 177° C. (350° F.). Thus, naphtha fuel product fractions have initial boiling points (or alternatively T5 boiling points) of at least about 35° C. and final boiling points (or alternatively T95 boiling points) of about 177° C. or less. It is noted that 35° C. roughly corresponds to a boiling point for the various isomers of a C5 alkane. When determining a boiling point or a boiling range for a feed or product fraction, an appropriate ASTM test method can be used, such as the procedures described in ASTM D2887 or D86.

Feedstock for Forming High Viscosity Base Stock—Group II Base Stock

The base stock compositions described herein can be formed from a variety of feedstocks. A convenient type of feed can be a Group II base stock formed by conventional solvent processing and/or hydroprocessing. Optionally, such a feed can be hydroprocessed to achieve a desired sulfur content, nitrogen content, and/or aromatics content. In some aspects, the feed can correspond to a "viscosity index expanded" Group II base stock. A "viscosity index expanded" Group II base stock is defined herein as a feed that has properties similar to a Group II base stock, but where the viscosity index for the feed is below the typical range for a Group II base stock. A viscosity index expanded Group II base stock as defined herein can have a viscosity index of at least 50. Still another option can be to use a feedstock that has a viscosity between 1.5 cSt and 5 cSt at 100° C., but that has an average molecular weight below the typical molecular weight for a Group II base stock.

A suitable Group II base stock, expanded viscosity index Group II base stock, and/or other low viscosity, low molecular weight feedstock for forming a high viscosity base stock as described herein can be characterized in a variety of ways. For example, a suitable Group II base stock (or other feedstock) for use as a feed for forming a high viscosity base stock can have a viscosity at 100° C. of 1.5 cSt to 20 cSt, or 1.5 cSt to 16 cSt, or 1.5 cSt to 12 cSt, or 1.5 cSt to 10 cSt, or 1.5 cSt to 8 cSt, or 1.5 cSt to 6 cSt, or 1.5 cSt to 5 cSt, or 1.5 cSt to 4 cSt, or 2.0 cSt to 20 cSt, or 2.0 cSt to 16 cSt, or 2.0 cSt to 12 cSt, or 2.0 cSt to 10 cSt, or 2.0 cSt to 8 cSt, or 2.0 cSt to 6 cSt, or 2.0 cSt to 5 cSt, or 2.0 cSt to 4 cSt, or 2.5 cSt to 20 cSt, or 2.5 cSt to 16 cSt, or 2.5 cSt to 12 cSt, or 2.5 cSt to 10 cSt, or 2.5 cSt to 8 cSt, or 2.5 cSt to 6 cSt, or 2.5 cSt to 5 cSt, or 2.5 cSt to 4 cSt, or 3.0 cSt to 20 cSt, or 3.0 cSt to 16 cSt, or 3.0 cSt to 12 cSt, or 3.0 cSt to 10 cSt, or 3.0 cSt to 8 cSt, or 3.0 cSt to 6 cSt, or 3.5 cSt to 20 cSt, or 3.5 cSt to 16 cSt, or 3.5 cSt to 12 cSt, or 3.5 cSt to 10 cSt, or 3.5 cSt to 8 cSt, or 3.5 cSt to 6 cSt.

Additionally or alternately, the feedstock can have a viscosity index of 50 to 120, or 60 to 120, or 70 to 120, or 80 to 120, or 90 to 120, or 100 to 120, or 50 to 110, or 60 to 110, or 70 to 110, or 80 to 110, or 90 to 110, or 50 to 100, or 60 to 100, or 70 to 100, or 80 to 100, or 50 to 90, or 60 to 90, or 70 to 90, or 50 to 80, or 60 to 80. It is noted that some of the above listed viscosity index ranges include viscosity index values that are outside (below) the definition for a Group II base stock, and therefore at least partially correspond to expanded viscosity index Group II base stocks and/or other low viscosity, low molecular weight feeds. In some aspects, at least 50 wt % of the feedstock, or at least 60 wt %, or at least 70 wt %, or at least 80 wt %, or at least 90 wt %, or substantially all of the feedstock (at least 95 wt %) can correspond to a Group II base stock or other low molecular weight feed having a viscosity index within the conventional range of viscosity index values for a Group Ii base stock, such as at least 80 and/or 120 or less. Optionally, the feedstock can include some Group I base stock and/or Group III base stock, such as at least 1 wt %, or at least 5 wt %, or at least 10 wt %, or at least 20 wt %, or at least 30 wt %, and/or less than 50 wt %, or 40 wt % or less, or 30 wt % or less, or 20 wt % or less, or 10 wt % or less. Each of the above lower bounds for an amount of Group I and/or Group III basestock in the feedstock is explicitly contemplated in conjunction with each of the above lower bounds.

As an alternative to characterizing a feed based on viscosity index, a feed can be characterized based on the paraffin content of the feed. In such aspects, a feed for forming a high viscosity base stock can have a paraffin content of at least 90 wt %, or at least 95 wt %.

Additionally or alternately, the feedstock can have a density at 15.6° C. of 0.91 g/cm3 or less, or 0.90 g/cm3 or less, or 0.89 g/cm3 or less, or 0.88 g/cm3, or 0.87 g/cm3, such as down to about 0.84 g/cm3 or lower.

Additionally or alternately, the molecular weight of the feedstock can be characterized based on number average molecular weight (corresponding to the typical average weight calculation), and/or based on mass or weight average molecular weight, where the sum of the squares of the molecular weights is divided by the sum of the molecular weights, and/or based on polydispersity, which is the weight average molecular weight divided by the number average molecular weight.

The number average molecular weight Mn of a feed can be mathematically expressed as $$M_n = \frac{\sum_i N_i M_i}{\sum_i N_i} \tag{1}$$

In Equation (1), Ni is the number of molecules having a molecular weight Mi. The weight average molecular weight, Mw, gives a larger weighting to heavier molecules. The weight average molecular weight can be mathematically expressed as $$M_w = \frac{\sum_i N_i M_i^2}{\sum_i N_i M_i} \tag{2}$$

The polydispersity can then be expressed as Mw/Mn. In various aspects, the feedstock can have a polydispersity of 1.30 or less, or 1.25 or less, or 1.20 or less, and/or at least about 1.0. Additionally or alternately, the feedstock can have a number average molecular weight (Mn) of 300 to 1000 g/mol. Additionally or alternately, the feedstock can have a weight average molecular weight (Mw) of 500 to 1200 g/mol.

In some aspects, a suitable Group II base stock, expanded viscosity index Group II base stock, and/or other low viscosity, low molecular weight feedstock for forming a high viscosity base stock as described herein can also be characterized based on sulfur content and/or aromatics content. For example, a suitable feedstock can have a sulfur content of 0.03 wt % (300 wppm) or less, or 200 wppm or less, or 100 wppm or less. Additionally or alternately, a suitable feedstock can have an aromatics content of 10 wt % or less, or 7 wt % or less, or 5 wt % or less.

Reactions to Form High Viscosity Base Stocks

There are various chemistry options that can be used for increasing the molecular weight of components found in Group II base stocks (optionally including expanded viscosity index Group II base stocks or other low molecular weight feeds). Examples of suitable reactions can include, but are not limited to, reactions such as olefin oligomerization, Friedel-Craft aromatic alkylation, radical coupling via peroxide, or catalyzed coupling using sulfur. In general, higher temperature reaction conditions can provide an increased reaction rate, while longer reaction times can improve the yield of coupled reaction product.

FIG. 1 shows an example of the general scheme for coupling compounds via radical coupling using a peroxide catalyst. The reaction shown in FIG. 1 is provided as an example, and is not intended to indicate a particular reaction location or product. As shown in FIG. 1, a compound is exposed to the presence of a peroxide, which results in formation of a radical. The radical compound has an increased reactivity which can facilitate coupling with another compound. It is noted that although the peroxide may be referred to as a catalyst herein, the peroxide is converted during the reaction from peroxide to two alcohols.

Figure 2:
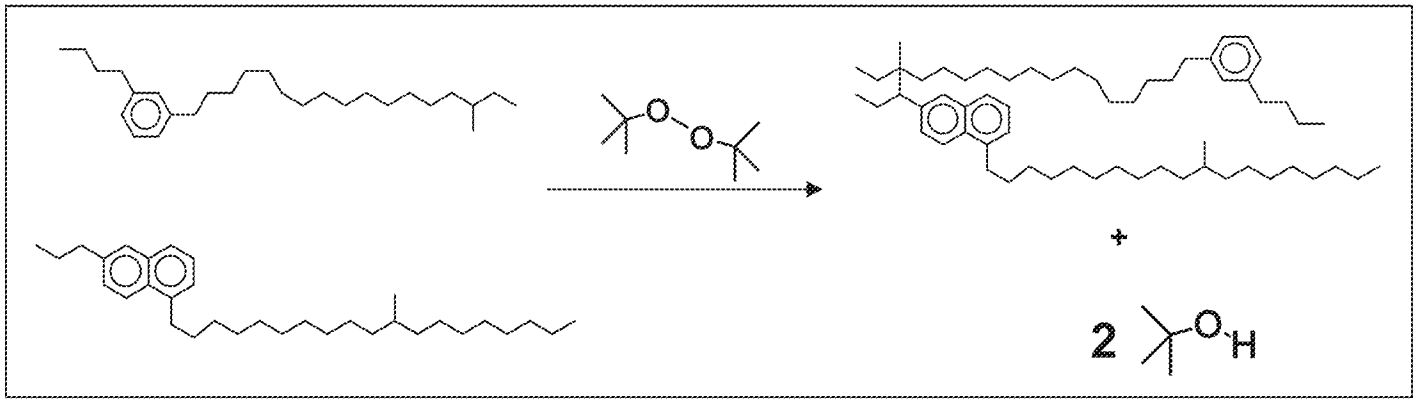
FIG. 2 schematically shows an example of a coupling reaction using a peroxide catalyst.

A similar schematic example of a radical coupling reaction with lubricant boiling range molecules is shown in FIG. 2. The reaction shown in FIG. 1 is provided as an example, and is not intended to indicate a particular reaction location or product. As shown in the example reaction in FIG. 2, radical coupling using peroxide can be used to couple two lubricant boiling range molecules together to form a larger compound. It has been discovered that converting a portion of a lubricant boiling range feed, such as a Group I lubricant base stock, to higher molecular weight compounds can produce a high viscosity lubricant base stock.

In the reaction scheme shown in FIG. 2, a dialkyl peroxide is used as the source of peroxide. Any convenient dialkyl peroxide can be used. Optionally, the alkyl groups in the peroxide can each include at least 3 carbons, or at least 4 carbons, or at least 5 carbons. In some aspects, the peroxide can be bonded to one or both of the alkyl groups at a tertiary carbon. For example, one or both of the alkyl groups can be a t-butyl (tertiary butyl) group. To facilitate the coupling reaction, a feedstock can be mixed with 5 wt % to 100 wt % (relative to the weight of the feedstock) of dialkyl peroxide (s), or 5 wt % to 70 wt %, or 5 wt % to 60 wt %, or 5 wt % to 50 wt %, or 5 wt % to 40 wt %, or 5 wt % to 30 wt %, or 5 wt % to 20 wt %, or 10 wt % to 80 wt %, or 10 wt % to 70 wt %, or 10 wt % to 60 wt %, or 10 wt % to 50 wt %, or 10 wt % to 40 wt %, or 10 wt % to 30 wt %, or 10 wt % to 20 wt %, or 15 wt % to 80 wt %, or 15 wt % to 70 wt %, or 15 wt % to 60 wt %, or 15 wt % to 50 wt %, or 15 wt % to 40 wt %, or 15 wt % to 30 wt %, or 20 wt % to 80 wt %, or 20 wt % to 70 wt %, or 20 wt % to 60 wt %, or 20 wt % to 50 wt %, or 20 wt % to 40 wt %, or 20 wt % to 30 wt %, or 25 wt % to 80 wt %, or 25 wt % to 70 wt %, or 25 wt % to 60 wt %, or 25 wt % to 50 wt %, or 25 wt % to 40 wt %, or 30 wt % to 80 wt %, or 30 wt % to 70 wt %, or 30 wt % to 60 wt %, or 30 wt % to 50 wt %, or 30 wt % to 40 wt %. The feedstock can be exposed to the dialkyl peroxide for a convenient period of time, such as about 10 minutes to about 10 hours. The temperature during exposure of the feedstock to the dialkyl peroxide can be from about 50° C. to about 300° C., preferably from about 120° C. to about 260° C., optionally at least about 140° C. and/or optionally about 230° C. or less. It is noted that while the above time and temperature conditions refer to batch operation, one of skill in the art can readily adapt this reaction as a continuous flow reaction scheme by selecting appropriate flow rates/residence times/temperatures. The reactor configuration and temperatures/space velocities described in U.S. Pat. No. 4,913,794 provide another example of conditions that can be used for formation of high viscosity, high quality base stocks, which is incorporated herein by reference with respect to the reactor configuration, temperatures, and space velocities.

Figure 3:
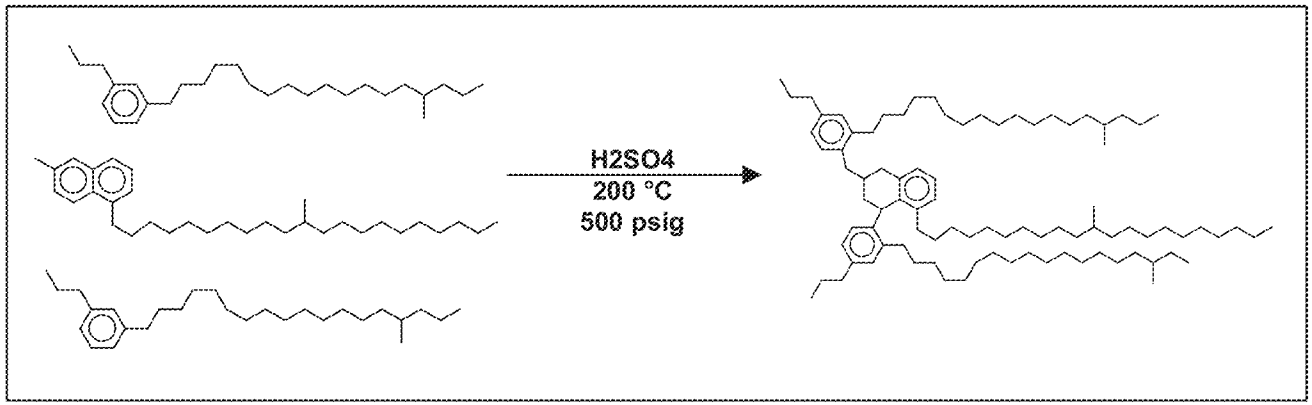
FIG. 3 schematically shows an example of a coupling reaction in an acidic reaction environment.
Figure 4:
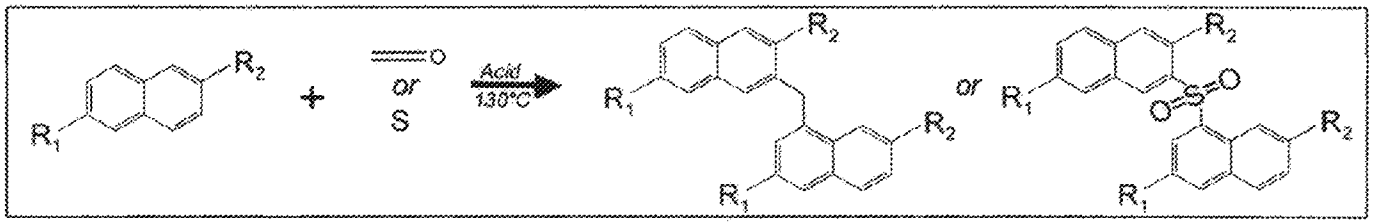
FIG. 4 schematically shows an example of a coupling reaction in an acidic reaction environment.
Figure 5:
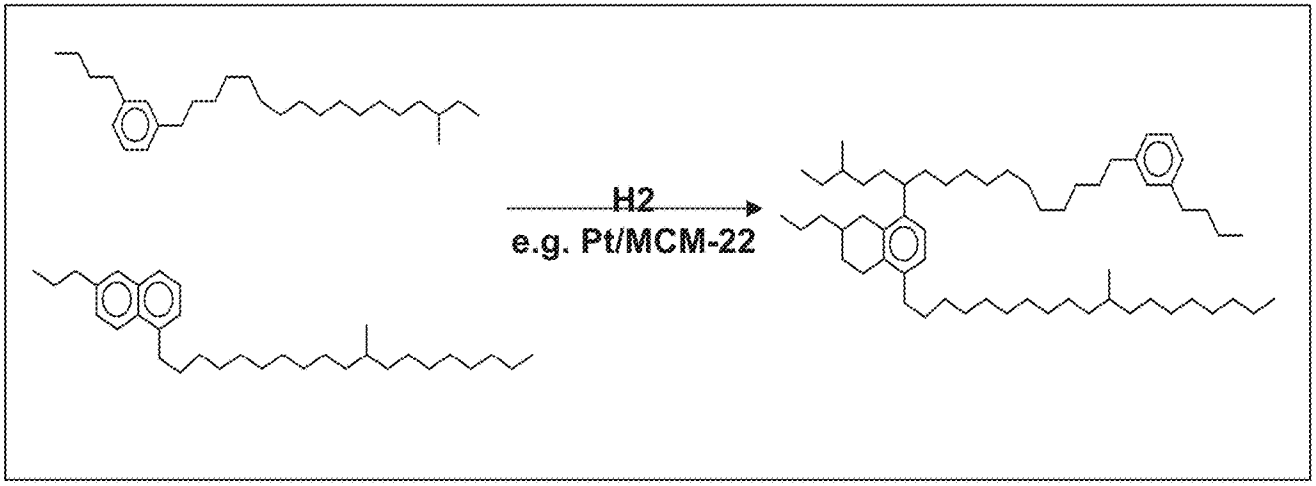
FIG. 5 schematically shows an example of a coupling reaction in the presence of a solid acid catalyst.

FIGS. 3 to 5 show schematic examples of other types of reaction schemes, including examples of aromatic coupling with sulfuric acid (FIG. 3), aromatic coupling with oxalic acid, formaldehyde, or sulfur (FIG. 4), and aromatic alkylation in the presence of a molecular sieve catalyst with a supported (noble) metal (FIG. 5). All of the reactions shown in FIGS. 3-5 are intended as examples, as these reaction mechanisms are generally known to those of skill in the art. Coupling using sulfuric acid as shown in FIG. 3 can generally be performed at temperatures between 150° C. and 250° C. and at pressures between about 100 psig (0.7 MPag) and 1000 psig (7 MPag). Coupling using sulfur or an organic compound containing a carbonyl group as shown in FIG. 4 can generally be performed at temperatures between 100° C. and 200° C. and/or at temperatures suitable for general Friedel-Craft alkylation. An additional acid can also be introduced into the reaction environment to catalyze the reaction. Suitable acids can include, for example, conventional catalysts suitable for Friedel-Craft alkylation. Aromatic alkylation in the presence of a molecular sieve with a supported metal is also a conventionally known process. FIG. 5 shows an example of aromatic alkylation performed in the presence of a Pt on MCM-22 catalyst, but any convenient conventional aromatic alkylation catalyst can be used.

Figure 6:
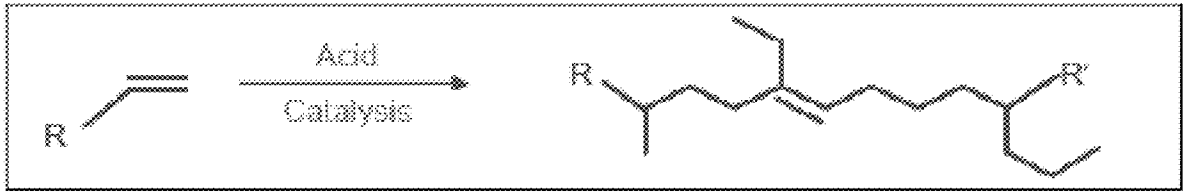
FIG. 6 schematically shows an example of a coupling reaction based on olefin oligomerization.

It is noted that all of the reaction mechanisms shown in FIGS. 1-5 involve elevated temperature and the presence of a peroxide catalyst, an acidic catalyst, and/or an acidic reaction environment. An additional reaction that can also occur under conditions similar to those shown in FIGS. 1-5 is olefin oligomerization, where two olefin-containing compounds within a feed are coupled to form a single larger olefin-containing compound. An example of an olefin oligomerization reaction is shown in FIG. 6. Optionally, if a low molecular weight feed otherwise suitable for Group II base stock formation and/or an (expanded) Group II base stock had a sufficient amount of olefin-containing compounds, olefin oligomerization could be used as the primary coupling reaction mechanism for forming a high viscosity base stock.

The product formed after exposing a Group II base stock and/or low molecular weight feed to a coupling reaction can correspond to a high viscosity base stock with desirable properties, or optionally additional hydroprocessing can be used to improve the properties of the high viscosity base stock. As an example, in aspects where the coupling reaction is based on a peroxide catalyst, the coupling reaction may introduce additional oxygen heteroatoms into the reaction product. Prior to hydroprocessing, the properties of the high viscosity base stock product may be less favorable due to the presence of the oxygen heteroatoms. Hydroprocessing of the high viscosity base stock can remove the oxygen heteroatoms, leading to improved properties.

Figure 7:
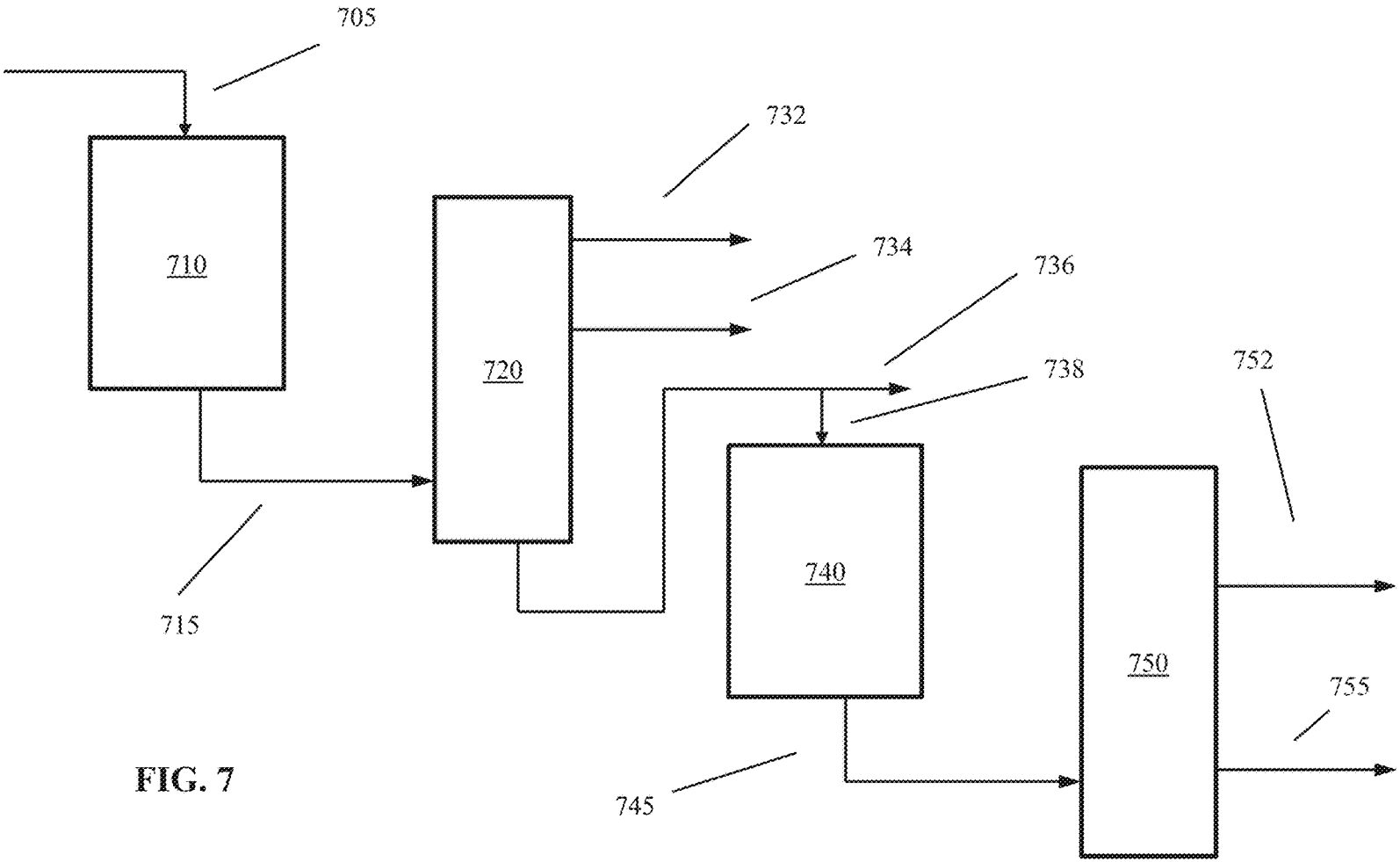
FIG. 7 schematically shows an example of a reaction system suitable for making a high viscosity composition as described herein.

FIG. 7 shows an example of a reaction system suitable for production of high viscosity base stocks as described herein. In FIG. 7, an initial feed 705 of Group II base stock (and/or expanded viscosity index Group II base stock and/or other low molecular weight feed) is passed into a coupling reaction stage 710, such as a reaction stage for coupling in the presence of a peroxide catalyst. The effluent 715 from the coupling stage is passed into a fractionator 720, such as a vacuum distillation column. The fractionator 720 can allow for separation of the coupling effluent 715 into a plurality of products, such as one or more light neutral products 732, one or more heavy neutral products 734, and a brightstock product 736. As shown in FIG. 7, optionally, a portion of the brightstock product 736 can be used without further treatment. The remaining portion 738 of the brightstock product can then be catalytically processed 740. It is noted that the brightstock product formed according to methods described herein can correspond to a Group II brightstock product based on the sulfur content, aromatics content, and VI of the brightstock product. Optionally, light neutral products and/or heavy neutral products can also be used without further treatment, or at least a portion can be catalytically processed. Catalytic processing 740 can include one or more of hydrotreatment, catalytic dewaxing, and/or hydrofinishing. The catalytically processed effluent 745 can then be separated 750 to form at least a fuels boiling range product 752 and a high viscosity base stock product 755. The fuels boiling range product can have a T95 boiling point of about 750° F. (399° C.) or less, or about 700° F. (371° C.) or less, or about 650° F. (343° C.) or less. Optionally, a plurality of fuels boiling range products 752 can be formed, with the additional fuels boiling range products corresponding to naphtha boiling range products, kerosene boiling range products, and/or additional lower boiling range diesel products.

It is noted that some feeds can allow for production of high viscosity base stocks as described herein without passing the coupled effluent through a catalytic processing stage 740. For example, high viscosity base stocks with a weight average molecular weight greater than 1500 g/mol and/or a number average molecular weight greater than 1200 g/mol can have favorable properties for use without additional catalytic processing after the coupling reaction.

Catalytic Processing Conditions

After the coupling reaction, the high viscosity base stocks described herein can be optionally but preferably catalytically processed to improve the properties of the base stock. The optional catalytic processing can include one or more of hydrotreatment, catalytic dewaxing, and/or hydrofinishing. In aspects where more than one type of catalytic processing is performed, the effluent from a first type of catalytic processing can optionally be separated prior to the second type of catalytic processing. For example, after a hydrotreatment or hydrofinishing process, a gas-liquid separation can be performed to remove light ends, H2S, and/or NH3 that may have formed.

Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 m2/g, or 150 to 250 m2/g; and a pore volume of from 0.25 to 1.0 cm3/g, or 0.35 to 0.8 cm3/g. More generally, any convenient size, shape, and/or pore size distribution for a catalyst suitable for hydrotreatment of a distillate (including lubricant base oil) boiling range feed in a conventional manner may be used. It is within the scope of the present disclosure that more than one type of hydroprocessing catalyst can be used in one or multiple reaction vessels.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as H2S and NH3 are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from about 100 SCF/B (standard cubic feet of hydrogen per barrel of feed) (17 Nm3/m3) to about 1500 SCF/B (253 Nm3/m3). Preferably, the hydrogen is provided in a range of from about 200 SCF/B (34 Nm3/m3) to about 1200 SCF/B (202 Nm3/m3). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 hr-1 to 10 hr-1; and hydrogen treat rates of 200 scf/B (35.6 m3/m3) to 10,000 scf/B (1781 m3/m3), or 500 (89 m3/m3) to 10,000 scf/B (1781 m3/m3).

Additionally or alternately, a potential high viscosity base stock can be exposed to catalytic dewaxing conditions. Catalytic dewaxing can be used to improve the cold flow properties of a high viscosity base stock, and can potentially also perform some heteroatom removal and aromatic saturation. Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than about 200:1, such as less than about 110:1, or less than about 100:1, or less than about 90:1, or less than about 75:1. In various embodiments, the ratio of silica to alumina can be from 50:1 to 200:1, such as 60:1 to 160:1, or 70:1 to 100:1.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal.

Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts can also include a binder. In some embodiments, the dewaxing catalysts can be formulated using a low surface area binder, where a low surface area binder represents a binder with a surface area of 100 m2/g or less, or 80 m2/g or less, or 70 m2/g or less. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone in a sour environment can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 m3/m3 (200 SCF/B) to 1781 m3/m3 (10,000 scf/B), preferably 178 m3/m3 (1000 SCF/B) to 890.6 m3/m3 (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 m3/m3 to about 1068 m3/m3 (1200 SCF/B to 6000 SCF/B). These latter conditions may be suitable, for example, if the dewaxing stage is operating under sour conditions. The LHSV can be from about 0.2 h-1 to about 10 h-1, such as from about 0.5 h-1 to about 5 h-1 and/or from about 1 h-1 to about 4 h-1.

Additionally or alternately, a potential high viscosity base stock can be exposed to hydrofinishing or aromatic saturation conditions. Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 hr-1 to about 5 hr-1 LHSV, preferably about 0.5 hr-1 to about 1.5 hr-1. Additionally, a hydrogen treat gas rate of from 35.6 m3/m3 to 1781 m3/m3 (200 SCF/B to 10,000 SCF/B) can be used.

Properties of High Viscosity Base Stocks

After exposing a feedstock to coupling reaction conditions, and after any optional catalytic processing, the resulting effluent can be fractionated to form at least a high viscosity base stock product. The high viscosity base stock product can be characterized in a variety of manners to demonstrate the novel nature of the composition.

In the examples described herein, the fractionation of the effluent from the coupling reaction corresponds to a fractionation to separate the parent feed material (lower molecular weight) from the products from the coupling reaction. This can be done, for example, using a short path single stage vacuum distillation, or via any other convenient type of temperature based separator/fractionator. Another fractionation option can be to further fractionate the coupled reaction product to create multiple base stocks, such as making both a heavy neutral and a bright stock range material from the coupled reaction product. Still another option could be to perform a fractionation so that the lightest (i.e., lowest molecular weight) portions of the couple reaction product are separated along with the initial feed. This type of narrower cut portion of the coupled reaction product could provide a higher viscosity base stock from the coupled reaction product but at the cost of a yield debit.

One direct method of characterization of a high viscosity base stock is to use Gel Permeation Chromatography (GPC)

to characterize the molecular weight distribution of the high viscosity base stock. GPC is a technique more commonly used for characterization of high molecular weight polymers. However, due to the higher molecular weight distribution of a high viscosity base stock as described herein relative to a conventional Group II base stock (or a conventional Group I bright stock), GPC can be beneficial for illustrating the differences.

Three quantities that can be determined by GPC (or by any other convenient mass characterization method) are polydispersity, Mw, and Mn, all as defined above.

With regard to a traditional average weight, a high viscosity feedstock can have a number average molecular weight (Mn) of 600 g/mol to 4000 g/mol. For example, the number average molecular weight can be 600 g/mol to 4000 g/mol, or 600 g/mol to 3500 g/mol, or 600 g/mol to 3000 g/mol, or 700 g/mol to 4000 g/mol, or 700 g/mol to 3500 g/mol, or 700 g/mol to 3000 g/mol, or 800 g/mol to 4000 g/mol, or 800 g/mol to 3500 g/mol, or 800 g/mol to 3000 g/mol, or 1000 g/mol to 4000 g/mol, or 1000 g/mol to 3500 g/mol, or 1000 g/mol to 3000 g/mol, or 1100 g/mol to 4000 g/mol, or 1100 g/mol to 3500 g/mol, or 1100 g/mol to 3000 g/mol, or 1200 g/mol to 4000 g/mol, or 1200 g/mol to 3500 g/mol, or 1200 g/mol to 3000 g/mol.

Additionally or alternately, a high viscosity feedstock can have a weight average molecular weight (Mw) of 1000 g/mol to 12000 g/mol. For example, the weight average molecular weight can be 1000 g/mol to 12000 g/mol, or 1000 g/mol to 10000 g/mol, or 1000 g/mol to 8000 g/mol, or 1000 g/mol to 7000 g/mol, or 1200 g/mol to 12000 g/mol, or 1200 g/mol to 10000 g/mol, or 1200 g/mol to 8000 g/mol, or 1200 g/mol to 7000 g/mol, or 1400 g/mol to 12000 g/mol, or 1400 g/mol to 10000 g/mol, or 1400 g/mol to 8000 g/mol, or 1400 g/mol to 7000 g/mol, or 1600 g/mol to 12000 g/mol, or 1600 g/mol to 10000 g/mol, or 1600 g/mol to 8000 g/mol, or 1600 g/mol to 7000 g/mol.

Additionally or alternately, a high viscosity base stock can have an unexpectedly high polydispersity relative to a base stock formed by conventional solvent and/or catalytic processing. The polydispersity can be expressed as Mw/Mn. In various aspects, the feedstock can have a polydispersity of at least 1.15, or at least 1.20, or at least 1.25, or at least 1.30, or at least 1.35, or at least 1.40, or at least 1.45, or at least 1.50, or at least 1.55, or at least 1.60, or at least 1.70, and/or 6.0 or less, or 5.0 or less, or 4.0 or less.

In addition to the above molecular weight quantities, GPC can also be used to quantitatively distinguish a high viscosity base stock from conventional Group I, Group II, and/or Group III base stocks based on the elution time of various components within a sample. The elution time in GPC is inversely proportional to molecular weight, so the presence of peaks at earlier times demonstrates the presence of heavier compounds within a sample. For a conventional base stock formed from a mineral petroleum feed, less than 0.5 wt % of the conventional base stock will elute prior to 23 minutes, which corresponds to a number average molecular weight (Mn) of about 3000 g/mol. This reflects the nature of a mineral petroleum sample, which typically contains little or no material having a molecular weight greater than 3000 g/mol. Similarly, for conventional Group II base stocks less than 0.5 wt % of the composition will elute prior to 24 minutes, corresponding to about 1800 g/mol. By contrast, the high viscosity Group II base stocks described herein can include substantial amounts of material having a molecular weight (Mn) greater than 1800 g/mol, or greater than 3000 g/mol, such as a high viscosity base stock having at least about 5 wt % of compounds with a molecular weight greater than 1800 g/mol, or at least about 10 wt %, or at least about 20 wt %, or at least about 30 wt %, or having at least about 5 wt % of compounds with a molecular weight greater than 3000 g/mol, or at least about 10 wt %, or at least about 20 wt %, or at least about 30 wt.

Another characterization method that can provide insight into compositional differences is Quantitative 13C-NMR. Using 13C-NMR, the number of epsilon carbons present within a sample can be determined based on characteristic peaks at 29-31 ppm. Epsilon carbons refer to carbons that are at least 5 carbons away from a branch (and/or a functional group) in a hydrocarbon. Thus, the amount of epsilon carbons is an indication of how much of a composition corresponds to wax-like compounds. For a Group I bright stock formed by conventional methods, the amount of epsilon carbons can be at least about 25 wt % to 27 wt %. This reflects the fact that typical Group I bright stock includes a high proportion of wax-like compounds. By contrast, a high viscosity Group II base stock as described herein can have a epsilon carbon content of 24.0 wt % or less, or 23.5 wt % or less, or 23.0 wt % or less, or 22.5 wt % or less, or 22.0 wt % or less, or 21.5 wt % or less. Such an epsilon carbon content in high viscosity (>20 cSt at 100° C.) Group II base stock as described herein can be comparable to the amount of epsilon carbons in a conventional heavy neutral (12 cSt at 100° C. or less) Group II base stock. The reduced amount of epsilon carbons in relation to the viscosity is unexpected given the coupling reactions used to form larger compounds for a high viscosity base stock. Without being bound by any particular theory, it is believed that the unexpectedly low epsilon carbon content of a high viscosity base stock can contribute to unexpectedly beneficial low temperature properties, such as pour point, cloud point, and low temperature viscosity.

An example of an unexpectedly beneficial low temperature property can be the crystallization temperature for a high viscosity base stock. Conventional Group I bright stocks can have crystallization temperatures between 0° C. and −10° C., which can pose difficulties with use in certain environments. By contrast, the high viscosity Group II base stocks described herein can have a crystallization temperature of −25° C. or less, or −30° C. or less, or −35° C. or less, or −40° C. or less, or −50° C. or less, or −60° C. or less.

Additionally or alternately, the high viscosity base stocks described herein can have favorable glass transition temperatures relative to a conventional high viscosity base stock. The high viscosity Group II base stocks described herein can have a glass transition temperature of −50° C. or less, or −60° C. or less, or −70° C. or less.

Although the composition of a high viscosity base stock as described herein is clearly different from a conventional Group II base stock and/or a conventional Group I bright stock, some properties of the high viscosity base stock can remain similar to and/or comparable to a conventional Group II base stock. The density at 15.6° C. of a high viscosity base stock can be, for example, 0.85 g/cm3 to 0.91 g/cm3, which is similar to the density for a conventional Group II heavy neutral base stock. For example, the density can be 0.85 g/cm3 to 0.91 g/cm3, or 0.85 g/cm3 to 0.90 g/cm3, or 0.85 g/cm3 to 0.89 g/cm3, or 0.86 g/cm3 to 0.91 g/cm3 or 0.86 g/cm3 to 0.90 g/cm3, or 0.86 g/cm3 to 0.89 g/cm3, or 0.87 g/cm3 to 0.91 g/cm3, or 0.87 g/cm3 to 0.90 g/cm3.

Another option for characterizing a high viscosity base stock as described herein relative to a conventional base stock is based on viscosity and/or viscosity index. With regard to viscosity, a convenient value for comparison can be kinematic viscosity at 40° C. or at 100° C. For a conventional Group II heavy neutral base stock, a kinematic viscosity at 40° C. of 50 cSt to 100 cSt is typical. For a conventional Group I bright stock, a kinematic viscosity at 40° C. of 460 cSt is desirable for meeting various specifications. By contrast, high viscosity base stocks as described herein can have kinematic viscosities at 40° C. of at least 150 cSt, or at least 200 cSt, or at least 250 cSt, or at least 300 cSt, or at least 350 cSt, or at least 400 cSt, such as up to about 30000 cSt or more. Additionally or alternately, the high viscosity base stocks described herein can have kinematic viscosities at 100° C. of at least 14 cSt, or at least 16 cSt, or at least 18 cSt, or at least 20 cSt, or at least 24 cSt, or at least 28 cSt, or at least 30 cSt, or at least 35 cSt, or at least 40 cSt, or at least 50 cSt, such as up to 1000 cSt or more. This is in comparison to a conventional Group II heavy neutral base stock, which can typically have a viscosity at 100° C. of 12 cSt or less. Thus, based on kinematic viscosity, the high viscosity Group II base stocks described herein can have viscosities comparable to a Group I bright stock while having other properties (such as density) comparable to a Group II heavy neutral base stock.

The viscosity index of a high viscosity base stock can also be suitable for use of the high viscosity base stock as a Group II base stock. In various aspects, the viscosity index of a high viscosity base stock can be about 80 to 120, or 90 to 120, or 100 to 120, or 105 to 120. Additionally or alternately, a high viscosity base stock as described herein can be characterized based on the saturates content, such as a base stock having a saturates content of at least 90 wt %, or at least 95 wt %.

Additionally or alternately, a high viscosity base stock can also have a desirable pour point. In various aspects, the pour point of a high viscosity base stock can be 0° C. or less, or −10° C. or less, or −20° C. or less, or −30° C. or less, or −40° C. or less, and/or down to any convenient low pour point value, such as −60° C. or even lower.

With regard to aromatics, the total aromatics in a high viscosity base stock can be about 10 wt % or less, or about 7 wt % or less, or about 5 wt % or less, or about 3 wt % or less, or about 1 wt % or less, or about 0.5 wt % or less.

Still another feature of a base stock can be the aniline point and/or the aniline point index of a base stock. Aniline point is a property that correlates with the ability to solvate polar compounds. Aniline point index is an index value that describes the aniline point of a base stock relative to an expected aniline point value for the base stock. For many typical base stocks, an expected aniline point can be calculated based on the formula Aniline point=10.79*[ln(viscosity@100° C.)]+94.688. The aniline point index for a base stock can be calculated by dividing the measured aniline point by the value predicted in the above equation. The base stocks described herein can have an aniline point index value of at least 1.05.

Examples of Characterization of High Viscosity Base Stocks

Examples 1-6 below correspond to high viscosity base stocks that were prepared by using a coupling reaction on a low viscosity feed. The feed for Examples 1, 2, 3, and 5 used was EHC-20, a commercially available low molecular weight hydroprocessed hydrocarbon feed having a viscosity of about 2.5 cSt at 100° C. Example 4 was formed using EHC-45 as a feed, which is a low viscosity (about 4.5 cSt) Group II base stock available from ExxonMobil Corporation. Example 6 was formed using a commercially available Fischer-Tropsch liquid with a viscosity of about 2.7 cSt.

For each of Examples 1-6, the initial feed was placed in a glass round-bottom flask equipped with a distillation condenser. Additional details regarding the reaction conditions and products from Examples 1-6 are shown in FIG. 9. The feed was first purged with nitrogen and then heated to 150° C. The radical initiator di-tert-butyl peroxide (DTBP, 10-100 wt % relative to weight of base stock in feed) was added slowly using a syringe pump over a period of 1-4 hours. The decomposition products of DTBP, tert-butanol (major) and acetone (minor), were continuously removed from the reaction mixture by distillation. After completing the addition of DTBP, the reaction mixture was maintained at 150° C. for additional 1-2 hours and then raised to 185° C. for another 1-2 hours. The excess and unreacted feed was first removed from the reaction mixture by vacuum distillation (<0.1 mm Hg or <0.013 kPa, 200° C.). For Examples 2-4, the remaining material was then hydro-finished over Pd/C catalyst, at 150° C.-200° C. under 500-1000 psig of hydrogen to yield the final product.

Performing a coupling reaction on a feed corresponding to a Group II base stock and/or another low molecular weight feed can produce a product having components of higher molecular weight than a lubricant base stock produced by conventional solvent processing and/or catalytic hydroprocessing. The higher molecular weight product can also have several properties not observed in conventional lubricant base oil products. Without being bound by any particular theory, it is believed that the unusual compositional properties of the high viscosity base stock are related to the ability of the high viscosity base stock to have a high molecular weight while retaining other base stock properties that are usually associated with lower molecular weight compounds.

Table 1 shows various molecular weight related properties for several basestocks. The first row shows properties for EHC 110 (available from ExxonMobil Corporation), which is a conventional Group II heavy neutral base stock. The second row shows properties for Core 600 (available from ExxonMobil Corporation), which is a conventional Group I heavy neutral base stock. Rows 3-8 correspond to Examples 1-6. Row 9 shows properties for Core 2500 (available from ExxonMobil Corporation), which is a conventional Group I bright stock. The final row shows properties for SpectraSyn™ 40, a polyalphaolefin base stock formed by oligomerization of C8 to C12 alpha olefins that is available from ExxonMobil Corporation.

TABLE 1

Molecular Weight Properties

| Description | Mw | Mn | PD = Mw/Mn | Wt % Eluted Before 24 min (>1800 Mn) |
|---|---|---|---|---|
| EHC 110, Group II Heavy Neutral | 708 | 501 | 1.41 | <0.2 |
| Core 600, Group I Heavy Neutral | 720 | 573 | 1.26 | <0.2 |
| Example 1 | 1315 | 1146 | 1.15 | 16 |
| Example 2 | 1690 | 1287 | 1.31 | 36 |
| Example 3 | 1749 | 1231 | 1.42 | 38 |
| Example 4 | 2309 | 1426 | 1.62 | 51 |
| Example 5 | 2527 | 1699 | 1.49 | 57 |
| Example 6 | 1941 | 1541 | 1.26 | 45 |
| Core 2500, Group I Bright Stock | 1163 | 966 | 1.20 | 9 |
| SpectraSyn 40, 40 cSt PAO | 2768 | 2188 | 1.27 | 78 |

For each composition, Table 1 shows the weight average molecular weight, number average molecular weight, polydispersity, and an additional attribute determined based on Gel Permeation Chromatography. The definitions for Mw, Mn, and polydispersity are provided above. The molecular weights of the samples were analyzed by Gel Permeation Chromatography (GPC) under ambient condition using a Waters Alliance 2690 HPLC instrument fitted with three 300 mm×7.5 mm 5 um PLgel Mixed-D columns supplied by Agilent Technologies. The samples were first diluted with tetrahydrofuran (THF) to ~0.6 w/v % solutions. A 100 uL of the sample solution was then injected onto the columns and eluted with un-inhibited tetrahydrofuran (THF) purchased from Sigma-Aldrich at 1 mL/min flow rate. Two detectors were used, corresponding to a Waters 2410 Refractive Index and a Waters 486 tunable UV detector @ 254 nm wavelength As shown in Table 1, the high viscosity base stocks of Examples 1-6 have molecular weights (Mw or Mn) that are greater than the molecular weight of the conventional Group I or Group II base stocks.

Table 1 also shows the polydispersity for the samples. As shown in Table 1, Examples 2-5 have a polydispersity of greater than 1.3, which indicates an unusually large amount of variation of molecular weights within the sample. By contrast, the conventionally formed Group I heavy neutral, Group I bright stock, and the polyalphaolefin base stock have polydispersity values below 1.3. While the Group II heavy neutral in row 1 of Table 1 has a polydispersity value above 1.3, it is noted that the number average molecular weight is less than 600 g/mol, indicating a much lower molecular weight composition than the high viscosity base stocks described herein.

Figure 8:
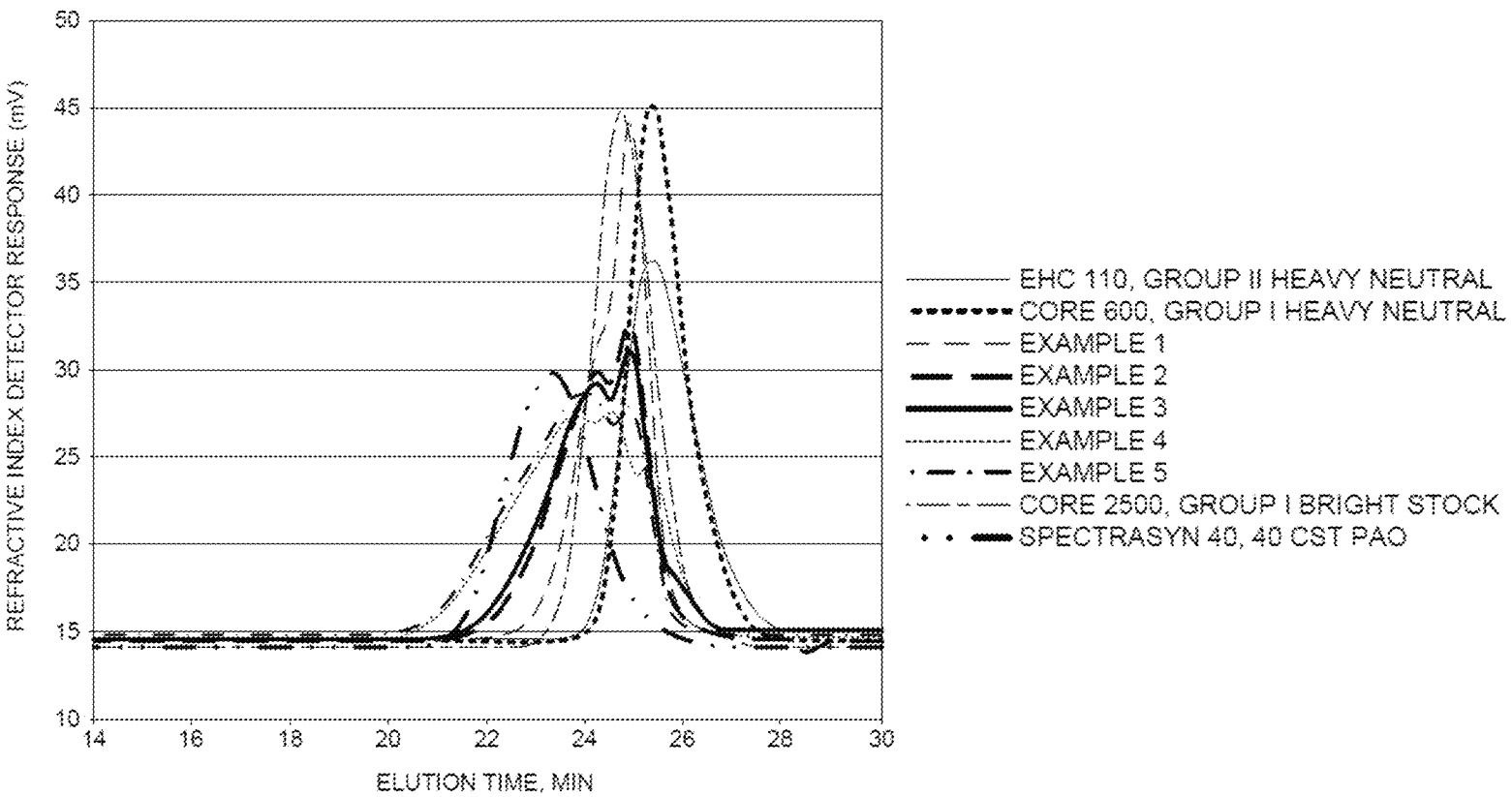
FIG. 8 shows Gel Permeation Chromatography results for various base stock samples.

The final column in Table 1 shows the weight percent of each sample that eluted prior to 24 minutes (corresponding to 1800 g/mol) during the Gel Permeation Chromatography (GPC) characterization. As noted above, the elution time in GPC is inversely proportional to molecular weight, so the presence of peaks prior to 24 minutes (or even prior to 23 minutes) demonstrates the presence of heavier compounds within a sample. The presence of peaks prior to 24 minutes by GPC was selected as a characteristic due to the fact that conventional mineral petroleum sources typically contain only a limited number compounds of this molecular weight. This is shown for the conventional heavy neutral base stocks in Table 1, where the weight percent that elutes before 24 minutes is less than 0.2 wt %. The Group I bright stock does have a limited amount of material that elutes before 24 minutes, but as shown in FIG. 8, almost none of the compounds in the Group I bright stock elute before 23 minutes. This clearly shows the contrast between a conventional Group I or Group II base stocks and the high viscosity base stocks described herein, as compounds are present within the high viscosity base stocks that are simply not present within conventional base stocks. Further details regarding the GPC characterization of each sample are shown in FIG. 8, which shows the full characterization results.

As shown in Table 1 and FIG. 8, performing a coupling reaction using a Group II base stock feed and/or a low viscosity, low molecular weight feed can generate compositions with unusual molecular weight profiles. The novelty of these high viscosity compositions can be further understood based on the properties of the compositions. FIG. 9 shows a variety of physical and chemical properties for the high viscosity base stocks from Examples 1-6 in comparison with the conventional EHC 110 heavy neutral base stock and the CORE 2500 Group I bright stock.

In FIG. 9, the first two properties shown correspond to kinematic viscosity at 40° C. and 100° C. The viscosity values for the conventional Group I and Group II base stocks are representative of expected values. Examples 1 to 6 have viscosities of at least 20 cSt, which is substantially higher than the conventional Group II heavy neutral base stock, while still having the favorable cold flow type properties of a Group II base stock. The viscosity index in FIG. 9 for Examples 1-6 is also between 80 and 120, as expected for a Group II base stock.

The next property in FIG. 9 is density. Conventionally, the density of an oligomerized base stock might be expected to increase relative to the density of the individual compounds used to form the oligomer. Conventionally, it would also be expected that an increased viscosity would correlate with an increased density. However, the formation of high molecular weight compounds in the base stocks in Examples 1-6 has not resulted in a substantial density increase. Instead, the density of the high viscosity base stocks in Examples 1-6 is comparable to the density of the conventional Group II base stock, and lower than the density of the Group I bright stock. Lower densities are desirable for base stocks as lower density usually correlates with improved energy efficiency. Thus, the high viscosity base stocks described herein provide a desirable alternative for applications that benefit from a high quality, energy efficient base stock.

Figure 10:
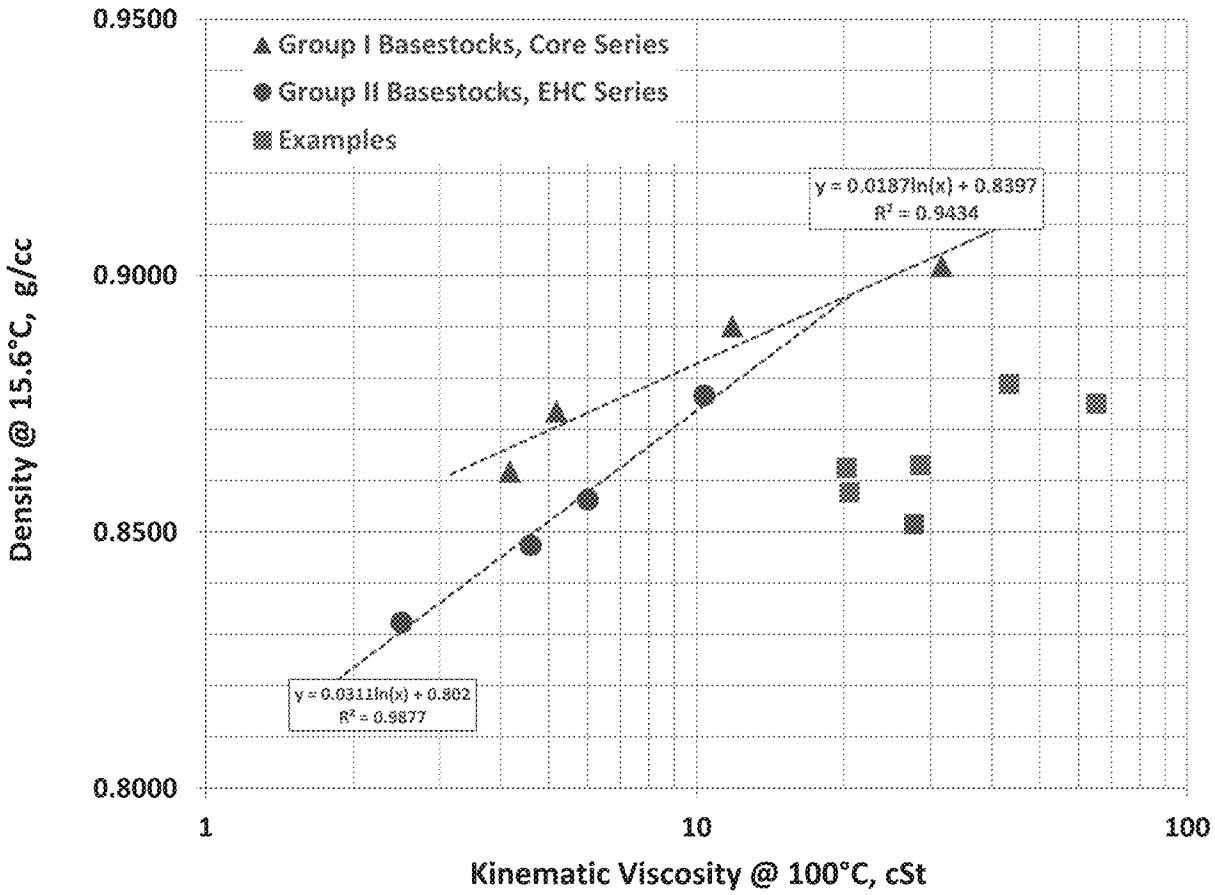
FIG. 10 shows density versus kinematic viscosity at 100° C. for various base stock samples.

The unexpected nature of the density of the high viscosity base stocks described herein relative to conventional base stocks is further illustrated in FIG. 10. FIG. 10 shows a log scale plot of kinematic viscosity at 100° C. versus density at 15.6° C. for a variety of base stocks. The squares in FIG. 10 correspond to Examples 1 to 6, which are high viscosity base stocks synthesized via a coupling reaction as described herein. The diamonds correspond to various commercially available Group II base stocks from the EHC series (available from Exxon Mobil). The triangles correspond to various commercially available Group I base stocks from the CORE series (available from Exxon Mobil). The respective trend lines show fits to the data points from the commercially available Group I and Group II base stocks. As shown in FIG. 10, the high viscosity base stocks described herein (such as Examples 1 to 6) have densities that are substantially lower than would be expected from the trend lines for conventional Group I or Group II base stocks.

The sulfur content of Examples 1-6 is similar to the expected sulfur content for a typical Group II base stock. This is in contrast to a typical Group I bright stock, which often has a substantial sulfur content.

The high viscosity base stocks described herein can also have an unexpectedly high aniline point relative to the base stock viscosity. As shown in FIG. 9, Examples 1-6 each have an aniline point of at least 130° C. (determined according to ASTM D611). This is in contrast to the aniline point for the conventional base stocks shown in FIG. 9, which each have an aniline point near 120° C.

Figure 11:
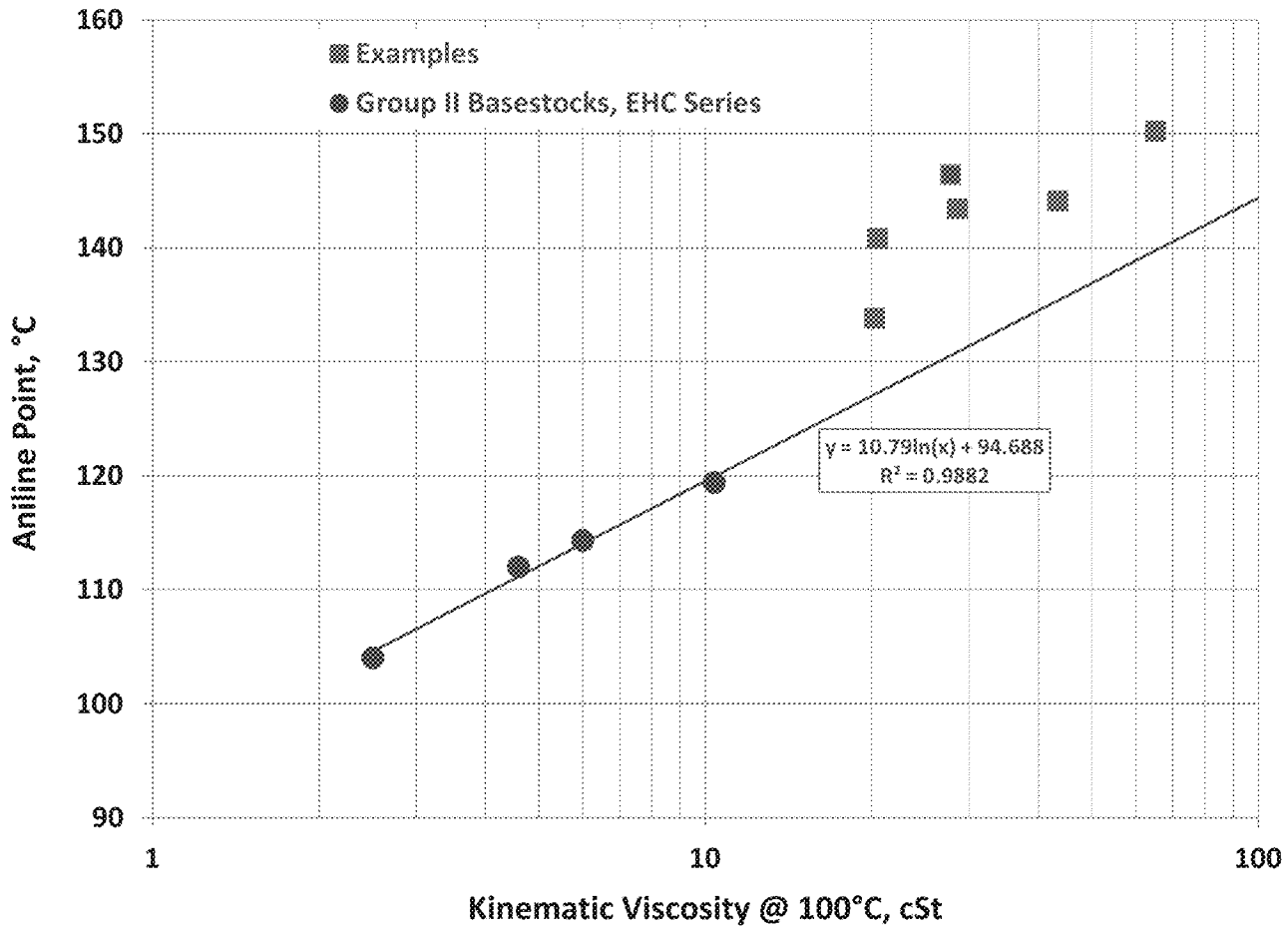
FIG. 11 shows aniline point index versus kinematic viscosity at 100° C. for various base stock samples.

The unexpected nature of the aniline point can also be seen in FIG. 11. FIG. 11 shows a log scale plot of kinematic viscosity at 100° C. versus aniline point for a variety of base stocks. The squares in FIG. 11 correspond to Examples 1 to 6, which are high viscosity base stocks synthesized via a coupling reaction as described herein. The diamonds correspond to various commercially available Group II base stocks from the EHC series (available from Exxon Mobil). The line shows the expected aniline point values for a Group II base stock, which can be used to determine the aniline point index. As shown in FIG. 11, Examples 1-6 all have an aniline point index that is greater than 1, indicating a higher aniline point than would be expected for a Group II base stock having a similar viscosity at 100° C.

The next two properties in FIG. 9 are glass transition temperature and crystallization temperature, as determined using differential scanning calorimetry. The glass transition temperature of the high viscosity base stocks described herein is comparable to but better than the glass transition temperature for a conventional Group I bright stock. However, the crystallization temperature for the high viscosity base stocks is unexpectedly superior to a conventional Group I bright stock. As shown in FIG. 9, the conventional Group I bright stock has a crystallization temperature between 0° C. and −10° C. By contrast, the high viscosity base stocks of Examples 2-4 have crystallization temperatures of −65° C. or lower. This is a substantial improvement in cold flow properties, and indicates that the high viscosity base stocks (which have viscosities more like a bright stock) can have comparable or even superior values relative to a Group II base stock for properties such as pour point and/or cloud point.

The final two properties in FIG. 9 are properties determined by 13C-NMR. One property is the percentage of epsilon carbons in the sample, which corresponds to a characteristic peak at 29-31 ppm. Epsilon carbons are carbons that are 5 carbons removed from a branch (and/or a functional group) in a hydrocarbon or hydrocarbon-like compound. Such epsilon carbons are indicative of the presence of long waxy chains within a sample. Although long waxy chains are commonly present in conventional lubricant base stocks, increased amounts of such long waxy chains typically correlate with less favorable values in cold flow properties such as pour point or cloud point. The conventional Group I bright stock in FIG. 9 has a typical value for epsilon carbons of about 27 wt %. Although the high viscosity base stocks of Examples 1-6 have viscosities similar to the Group I bright stock, Examples 1-6 also have less than 23.5 wt % of epsilon carbons, similar to the much lower viscosity Group II heavy neutral base stock.

The 13C-NMR can also be used to determine the amount of aromatic carbons in a sample, based on peaks between 117 ppm and 150 ppm. For Examples 2-4 that were characterized using 13C-NMR, the measured amount of aromatics was comparable to the Group II heavy neutral base stock.

Example 5: Lubricant Formulation—Gear Oil Properties

In addition to the above physical and chemical properties, high viscosity base stocks can provide other types of improved properties. In this Example, the high viscosity base stock corresponding to Example 3 was used to formulate an ISO VG 220 gear oil. An ISO VG 220 gear oil was also formulated using the conventional CORE 2500 Group I bright stock. The same amount of the same additive package and the same rebalancing light neutral base stock were used for both gear oils to make the required viscosity grade. Two formulation performance features were measured. One measured feature was low temperature properties using ASTM test method D2983-13, Brookfield viscosity at −20° C. A second measured feature was oxidation stability using ASTM test method D2983-2, US Steel Oxidation at 121° C. for 13 days.

Figure 12:
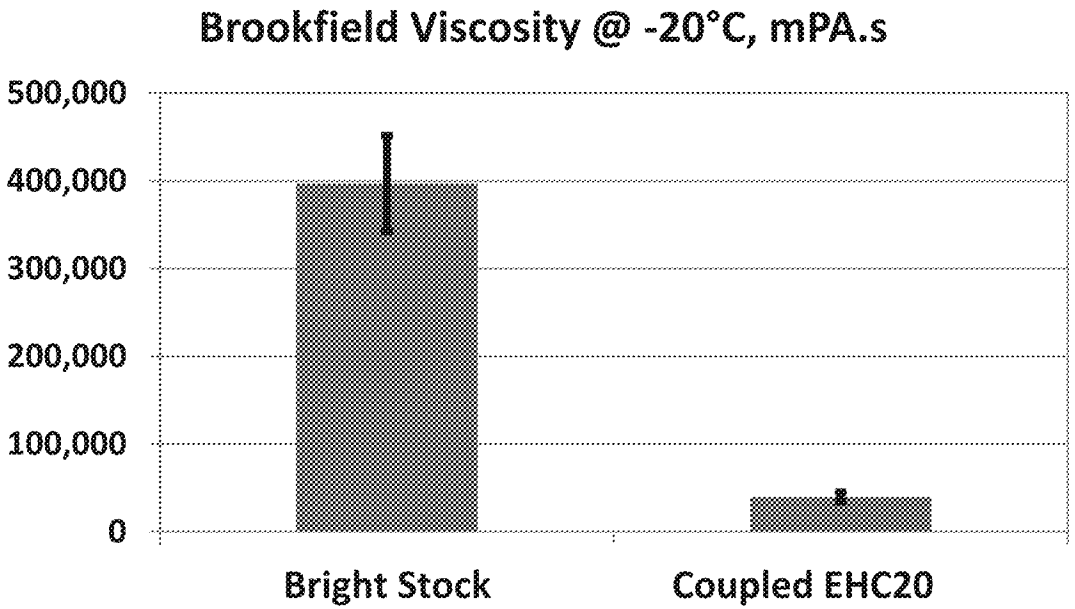
FIG. 12 shows Brookfield viscosity data for lubricants formulated using various base stocks.

FIG. 12 shows a comparison of the Brookfield viscosity at −20° C. for the gear oil formulated using the conventional Group I bright stock and the gear oil formulated using the high viscosity Group II base stock of Example 3. As shown in FIG. 12, the gear oil formulated using Example 3 has a Brookfield viscosity of less than 100,000, while the gear oil formulated using the conventional Group I bright stock has a viscosity near 400,000. It is noted that the crystallization temperature of the conventional bright stock is between 0° C. and −10° C., which likely contributes to the high viscosity. The lower crystallization temperature (and/or other beneficial low temperature properties) of the high viscosity base stock of Example 3 allows the formulated gear oil to retain a desirable viscosity at low temperatures.

Figure 13:
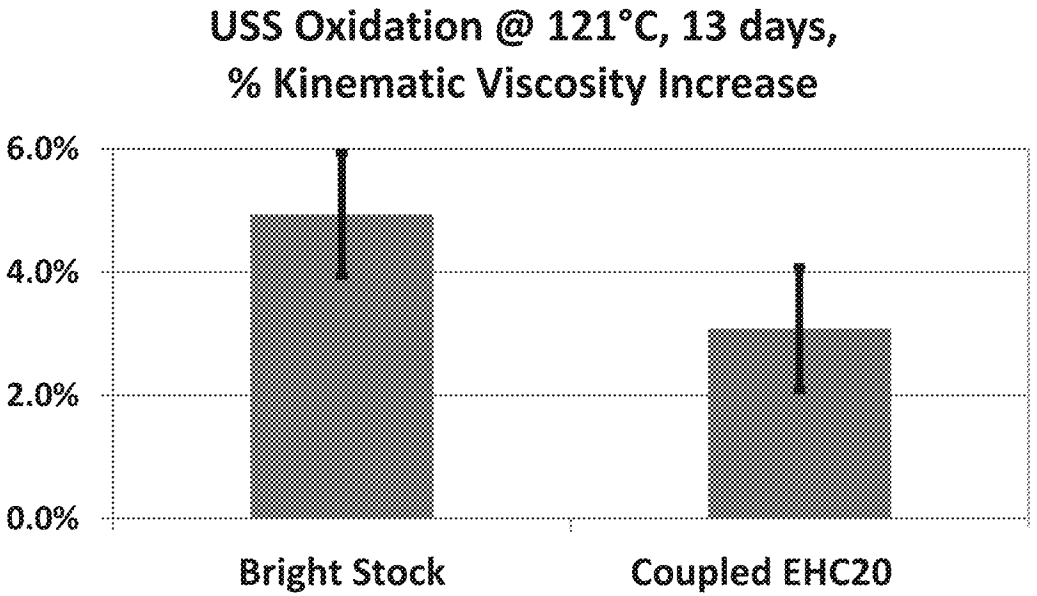
FIG. 13 shows oxidation induced changes in kinematic viscosity for lubricants formulated using various base stocks.

FIG. 13 shows results from performing the US Steel oxidation test on the gear oils formulated using the conventional bright stock and the high viscosity base stock of Example 3, respectively. Conventionally, a gear oil formulated using a higher molecular weight base stock would be expected to perform less favorably under this severe oxidation test. However, in spite of the substantially higher molecular weight, the gear oil formulated using the high viscosity Group II base stock of Example 3 had a lower but comparable degree of oxidation (similar to within the experimental error of the method) to the gear oil formulated using the conventional Group I bright stock.

Example 6: Lubricant Formulation—Gear Oil Properties

In this Example, the high viscosity base stock corresponding to Example 3 was used to formulate an ISO VG 220 gear oil. A second ISO VG 220 gear oil was formulated using the conventional CORE 2500 Group I bright stock. A third ISO VG 220 gear oil was formulated using the polyalphaolefin base stock shown in the final row of Table 1. The same amount of the same additive package and the same rebalancing light neutral base stock were used for the formulated gear oils to make the required viscosity grade. Two formulation performance features were measured. One measured feature was low temperature properties using ASTM test method D2983, Brookfield viscosity at −35° C. A second measured feature was oxidation stability using ASTM test method D2272, the Rotating Pressure Vessel Oxidation Test (RPVOT) at 150° C.

Figure 14:
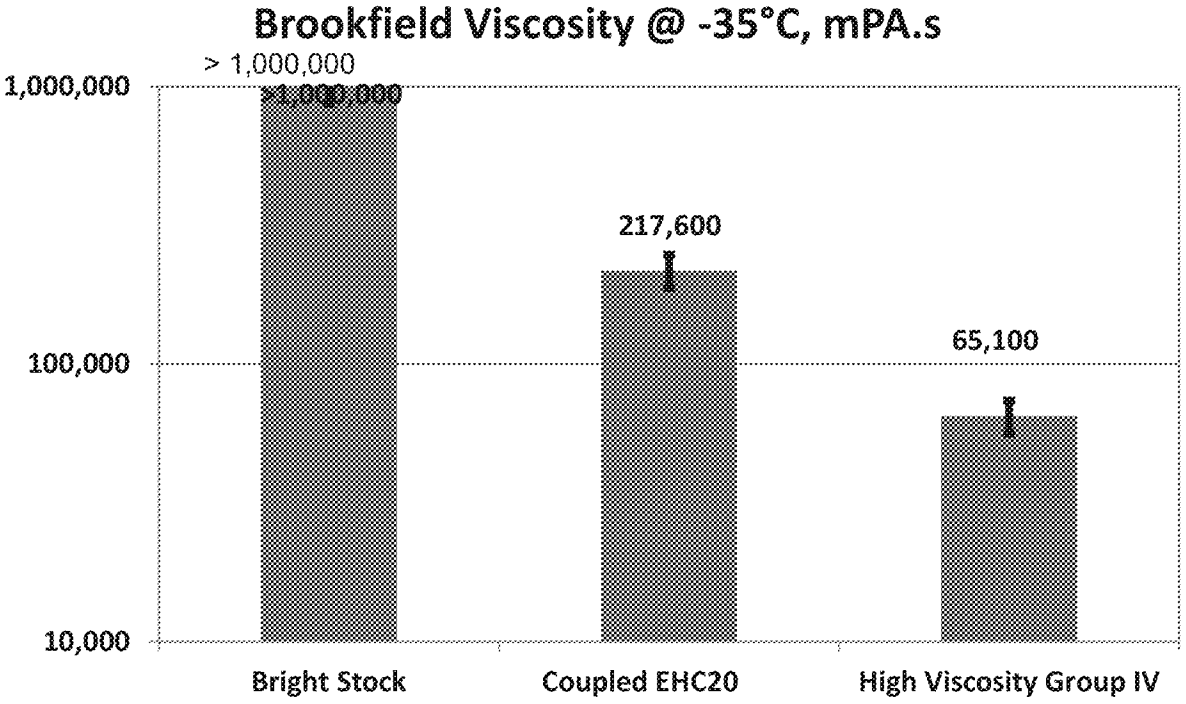
FIG. 14 shows Brookfield viscosity data for lubricants formulated using various base stocks.

FIG. 14 shows a comparison of the Brookfield viscosity at −35° C. for the gear oil formulated using the conventional Group I bright stock, the gear oil formulated using the high viscosity base stock of Example 3, and the gear oil formulated using the polyalphaolefin (high viscosity Group IV) base stock. As shown in FIG. 14, the gear oil formulated using Example 3 has a Brookfield viscosity at −35° C. of about 217,000, while the gear oil formulated using the conventional bright stock has a Brookfield viscosity at −35° C. that exceeds the test limit of 1,000,000. As in Example 5, formulating a gear oil using the high viscosity Group II base stocks described herein provides superior low temperature performance relative to a conventional Group I bright stock. In FIG. 14, it is not surprising that the gear oil formulated using the Group IV base stock provides a still lower Brookfield viscosity at −35° C.

Figure 15:
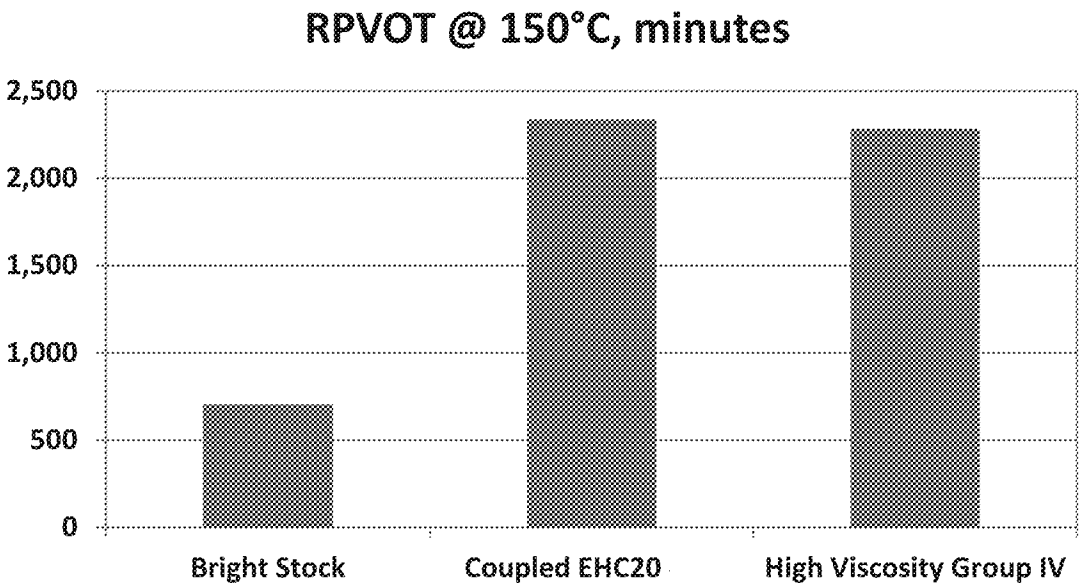
FIG. 15 shows RPVOT data for lubricants formulated using various base stocks.

FIG. 15 shows results from a Rotating Pressure Vessel Oxidation Test (RPVOT), a demanding test for assessing highly stable gear oils, that was performed on gear oils formulated using the same types of base stocks as in FIG. 14. In the RPVOT oxidation stability test, the gear oil formulated using the high viscosity base stock of Example 3 outperformed similarly the gear oil formulated using the traditional bright stock by a factor of three (2,335 minutes versus 705 minutes, as shown in FIG. 15). In fact, the gear oil formulated using the base stock from Example 3 performed similarly to the gear oil formulated using the Group IV polyalphaolefin (2,335 minutes versus 2,282 minutes, as shown in FIG. 15).

Additional Embodiments

Embodiment 1

A base stock composition having a number average molecular weight (Mn) of 600 g/mol to 4000 g/mol, a weight average molecular weight (Mw) of 1000 g/mol to 12000 g/mol, a polydispersity (Mw/Mn) of at least 1.15, a sulfur content of 0.03 wt % or less, an aromatics content of 10 wt % or less, a kinematic viscosity at 100° C. of at least 14 cSt, a kinematic viscosity at 40° C. of at least 150 cSt, and a viscosity index of 50 to 120.

Embodiment 2

The composition of claim 1, wherein the viscosity index is at least 80, or at least 90, or at least 100.

Embodiment 3

A base stock composition having a number average molecular weight (Mn) of 600 g/mol to 4000 g/mol, a weight average molecular weight (Mw) of 1000 g/mol to 12000 g/mol, a polydispersity (Mw/Mn) of at least 1.15, a sulfur content of 0.03 wt % or less, an aromatics content of 10 wt % or less, a kinematic viscosity at 100° C. of at least 14 cSt, a kinematic viscosity at 40° C. of at least 150 cSt, and a saturates content of greater than 90 wt %, or greater than 95 wt %.

Embodiment 4

The composition of any of the above embodiments, wherein the polydispersity is at least 1.3, or at least 1.4, or at least 1.5, or at least 1.6, or at least 1.7.

Embodiment 5

The composition of any of the above embodiments, wherein the composition has 24.0 wt % or less of epsilon carbons as determined by 13C-NMR, or 23.5 wt % or less, or 23.0 wt % or less, or 22.5 wt % or less, or 22.0 wt % or less.

Embodiment 6

The composition of any of the above embodiments, wherein the number average molecular weight (Mn) is at least 700 g/mol, or at least 800 g/mol, or at least 1000 g/mol, or at least 1200 g/mol.

Embodiment 7

The composition of any of the above embodiments, wherein the weight average molecular weight (Mw) is at least 1200 g/mol, or at least 1400 g/mol.

Embodiment 8

The composition of any of the above embodiments, wherein the composition has a pour point of 0° C. or less, or −10° C. or less, or −20° C. or less, or −30° C. or less.

Embodiment 9

The composition of any of the above embodiments, wherein the composition has a glass transition temperature of −50° C. or less, or −60° C. or less, or −70° C. or less; or wherein the crystallization temperature is −20° C. or less, or −30° C. or less, or −40° C. or less, or −50° C. or less; or a combination thereof.

Embodiment 10

The composition of any of the above embodiments, wherein the composition has an aniline point index of at least 1.05.

Embodiment 11

The composition of any of the above embodiments, wherein the composition has a density of 0.85 g/cm3 to 0.91 g/cm3, or at least 0.86 g/cm3, or at least 0.87 g/cm3, or 0.90 g/cm3 or less.

Embodiment 12

The composition of any of the above embodiments, wherein the composition has a) a kinematic viscosity at 40° C. of at least 200 cSt, or at least 250 cSt, or at least 300 cSt, or at least 350 cSt; b) a kinematic viscosity at 100° C. of at least 16 cSt, or at least 18 cSt, or at least 20 cSt, or at least 24 cSt, or at least 28 cSt, or at least 30 cSt, or at least 35 cSt, or at least 40 cSt; or c) a combination thereof.

Embodiment 13

A formulated lubricant comprising the base stock composition of any of the above claims.

Embodiment 14

A method of forming a base stock composition, comprising: introducing a feedstock having a viscosity index of 50 to 120, a kinematic viscosity at 100° C. of 12 cSt or less, a sulfur content less than 0.03 wt %, and an aromatics content less than 10 wt %, into a coupling reaction stage under effective coupling conditions to form a coupled effluent; and fractionating the coupled effluent to form at least a first product fraction having a viscosity index of 50 to 120, a polydispersity (Mw/Mn) of at least 1.15, a kinematic viscosity at 100° C. of at least 14 cSt, a kinematic viscosity at 40° C. of at least 150 cSt, and a pour point of 0° C. or less.

Embodiment 15

A method of forming a base stock composition, comprising: introducing a feedstock having a paraffin content of at least 90 wt % (optionally at least 95 wt %), a kinematic viscosity at 100° C. of 12 cSt or less, a sulfur content less than 0.03 wt %, and an aromatics content less than 10 wt %, into a coupling reaction stage under effective coupling conditions to form a coupled effluent; and fractionating the coupled effluent to form at least a first product fraction having a saturates content of at least 90 wt % (optionally at least 95 wt %), a polydispersity (Mw/Mn) of at least 1.15, a kinematic viscosity at 100° C. of at least 14 cSt, a kinematic viscosity at 40° C. of at least 150 cSt, and a pour point of 0° C. or less.

Embodiment 16

The method of Embodiment 14 or 15, further comprising exposing at least a portion of the coupled effluent to a catalyst under effective catalytic processing conditions to form a catalytically processed effluent, wherein fractionating at least a portion of the coupled effluent comprises fractionating at least a portion of the catalytically processed effluent.

Embodiment 17

The method of any of Embodiments 14 to 16, wherein the effective catalytic processing conditions comprises at least one of hydrotreatment conditions, catalytic dewaxing conditions, and hydrofinishing conditions.

When numerical lower limits and numerical upper limits are listed herein, ranges from any lower limit to any upper limit are contemplated. Although the present disclosure has been described in terms of specific embodiments, it is not so limited. Suitable alterations/modifications for operation under specific conditions should be apparent to those skilled in the art. It is therefore intended that the following claims be interpreted as covering all such alterations/modifications as fall within the true spirit/scope of the disclosure.

The invention claimed is:

1. A method of forming a base stock composition, comprising:

introducing a feedstock having a viscosity index of 50 to 120, a kinematic viscosity at 100° C. of 12 cSt or less, a sulfur content less than 0.03 wt %, and an aromatics content less than 10 wt %, into a coupling reaction stage under effective coupling conditions to form a coupled effluent; and fractionating the coupled effluent to form at least a first product fraction having a viscosity index of 50 to 120, a polydispersity ($M_w/M_n$) of at least 1.15, a kinematic viscosity at 100° C. of at least 14 cSt, a kinematic viscosity at 40° C. of at least 150 cSt, and a pour point of 0° C. or less.

2. The method of claim 1, further comprising exposing at least a portion of the coupled effluent to a catalyst under effective catalytic processing conditions to form a catalytically processed effluent, wherein fractionating at least a portion of the coupled effluent comprises fractionating at least a portion of the catalytically processed effluent.

3. The method of claim 1, wherein the effective catalytic processing conditions comprises at least one of hydrotreatment conditions, catalytic dewaxing conditions, and hydrofinishing conditions.

4. The method of claim 1, wherein the feedstock comprises a paraffin content of at least 90 wt %.

* * * * *